US007798175B2

(12) United States Patent
McBride

(10) Patent No.: US 7,798,175 B2
(45) Date of Patent: Sep. 21, 2010

(54) HIGH CAPACITY WATER DIVERSION CONDUIT

(76) Inventor: Todd McBride, 832 East Chestermere, Chestermere, AL (CA) T1X 1A7

( * ) Notice: Subject to any disclaimer, the term of this patent is extended or adjusted under 35 U.S.C. 154(b) by 107 days.

(21) Appl. No.: 12/112,137

(22) Filed: Apr. 30, 2008

(65) Prior Publication Data

US 2009/0269139 A1 Oct. 29, 2009

(30) Foreign Application Priority Data

Apr. 23, 2008 (CA) ..... 2629539

(51) Int. Cl.
*F15D 1/04* (2006.01)

(52) U.S. Cl. ..... 138/39; 138/37; 405/52; 405/80

(58) Field of Classification Search ..... 138/39, 138/37, 42; 250/461.1, 504 R; 405/52, 60, 405/80

See application file for complete search history.

(56) References Cited

U.S. PATENT DOCUMENTS 298,657 A * 5/1884 Bennett ..... 138/109
1,467,168 A * 9/1923 Kaplen ..... 138/37
1,984,802 A 12/1934 Mallery ..... 405/80
2,611,685 A * 9/1952 Yoder ..... 422/143
3,587,239 A * 6/1971 Feland ..... 405/125
3,860,360 A * 1/1975 Yu ..... 415/208.3
4,073,146 A * 2/1978 Atencio ..... 405/78
4,130,173 A * 12/1978 Cooksey ..... 181/212
4,352,593 A * 10/1982 Iskra et al. ..... 405/108
4,354,661 A 10/1982 Welker ..... 251/118
4,368,121 A * 1/1983 Vasiliev et al. ..... 210/170.01
4,437,431 A * 3/1984 Koch ..... 405/83
4,498,806 A * 2/1985 Szonnell ..... 405/34
4,892,442 A * 1/1990 Shoffner ..... 405/183.5
5,165,452 A * 11/1992 Cheng ..... 138/37
5,242,244 A 9/1993 Dockery ..... 405/52
5,411,619 A * 5/1995 Sundqvist et al. ..... 156/187
5,683,276 A 11/1997 Jordan ..... 440/38
5,937,908 A * 8/1999 Inoshiri et al. ..... 138/39
5,947,640 A 9/1999 Connors ..... 405/83
6,976,508 B2 * 12/2005 Ueberall ..... 138/39
7,270,791 B2 * 9/2007 Davis et al. ..... 422/139
2005/0229989 A1 * 10/2005 Su ..... 138/115
2008/0138156 A1 * 6/2008 Janesky ..... 405/40

* cited by examiner

*Primary Examiner*—Patrick F Brinson
(74) *Attorney, Agent, or Firm*—Heslin Rothenberg Farley & Mesiti PC; Alana M. Fuierer; Victor A. Gardona

(57) ABSTRACT

A fluid diversion conduit is described for diverting the flow of fluid, and particularly for diverting water from a stream to a discharge location. The discharge end of the duct has a segment of gradually enlarging cross sectional area, forming a hydraulic flow diffuser. Water flow through this segment is thereby slowed as the flow area increases, and most of the dynamic head of the water flow is recovered, improving flow capacity of the conduit. The rate of flow through the conduit may be monitored and controlled to achieve streamline flow in the diffuser section, and to prevent air from entering the diffuser section. Air entering the conduit may be expelled or otherwise displaced from the conduit.

19 Claims, 4 Drawing Sheets

HIGH CAPACITY WATER DIVERSION CONDUIT

CROSS-REFERENCE TO RELATED APPLICATIONS

This application claims priority from Canadian Patent Application No. 2,629,539 filed on Apr. 23, 2008, the entire contents of which are incorporated herein by reference.

FIELD OF THE INVENTION

The present invention relates generally to fluid diversion conduits. More particularly, the present invention relates to a conduit with reduced hydraulic resistance and improved flow capacity for use in diverting stream flow during construction operations.

BACKGROUND OF THE INVENTION

It is often necessary to divert a stream from a section of its natural streambed during various construction projects, such as road, bridge, or buried pipeline crossing construction. The stream diversion is required to avoid disrupting the stream flow and releasing turbidity into the downstream waters. A typical construction activity that requires this "isolate and bypass" method is the installation of a buried pipeline crossing under the streambed. In order to minimize the environmental disturbance to aquatic life in the stream, the natural water flows must be maintained from one side of the project to the other during construction, and sediments from the construction operation must not be allowed to mix with the flow. It may also be necessary to allow "dry" access to the diverted section of streambed for excavation or other construction activities.

The normal "isolate and bypass" construction practice is to install upstream and downstream cofferdams and divert the flow through some form of conduit, commonly a channel, hose, flume or duct. The flow diversion may be achieved by excavating a bypass flow channel adjacent the natural streambed, installing pumps and pipelines, installing flumes, or installing large box shaped flow channels commonly known as "superflumes" if the natural volume of flow is substantial. Upon completion of construction, the streambed is appropriately restored and flow is returned to the streambed following removal of the temporary flow bypass system.

The diversion, or bypass system must have the capacity to handle the range of stream flows experienced while it is in use. In many streams flow will be nominal. However a very high potential stream surge flow, or "freshet", may be experienced after a precipitation event. If the diversion system cannot handle such flow volumes, a catastrophic flooding of the construction site may occur, with significant downstream environmental impacts. Statistical analysis of the historical stream flow rates during the planned season of construction activity is required to estimate the likely and potential maximum flows to be diverted.

In situations where the stream flow rates are expected to be significant, exceeding the typical capability of pumping systems, long culverts, or "flumes", made of large diameter steel pipe are often used for the diversion. The flume spans between the upstream and downstream cofferdams in a straight line, and is of sufficient diameter to handle the excess flow.

The flow capacity of the flume is limited by the hydraulic head difference between the water levels behind the cofferdams. The upstream dam must back up the stream sufficiently to produce adequate hydraulic head differential to induce the required flow in the flume such that a normal volume of flow is delivered past the diverted section of streambed. In some cases both the upstream and downstream water level is above the flume elevation and it operates as a simple flowing water pipe where the flow is dependent on the difference between the upstream and downstream heads. In other cases the downstream water level is lower than the flume discharge and the flume operates as a partially filled culvert where the flow rate is governed by difference between upstream head and the flume elevation. This hydraulic condition is known as "inlet controlled", as the flow is limited by the upstream head and its inherent ability to flow water into the entrance of the flume.

In streams where very large flow volumes must be diverted, the required capacity cannot be provided economically with the large pipe flumes discussed above. On these rare occasions, larger box shaped flumes, often called "superflumes", are used to provide a larger conduit cross sectional area to accommodate larger anticipated flows. These structures are necessarily huge, heavy, and expensive to build. They are also expensive to transport and install. Another disadvantage to the large size of these superflumes is the resulting limitation of access to the streambed for excavation and underground pipe installation.

Further, the flow in a box channel "superflume" is generally limited by inlet conditions. To achieve high flow rates it is necessary to dam the upstream water level to significant depths. Since the total force on the dam increases approximately with the inlet depth squared, this becomes an expensive undertaking as well.

The high discharge flow velocity out of flumes generally poses an erosion problem in the downstream bed. Thus, the downstream flow is often manually altered upon exit from the flume by placement of rocks or rubble within the streambed to increase turbulence and thereby diffuse discharge flow from the flume.

In larger streams, the total construction process to install and remove a large superflume system may substantially increase the duration of the in-stream construction activities. This increases the environmental impacts to the stream and also increases the probability that a stream freshet will occur during the isolate and bypass operation.

Flexible tubes have been used to divert water from a stream. U.S. Pat. No. 5,242,244 to Dockery describes a sleeve for isolating a flowing water stream from surrounding stagnant waters so that selective chemical treatment of the stagnant water is possible.

U.S. Pat. No. 5,947,640 to Connors describes a flexible tube system for conveying water past a construction site in a streambed. This invention provides an economical and highly portable method of conveying water through a flexible tube that must be continuously supported along its length. No significant measures to enhance the hydraulic capacity of the tube are considered and the flexible wall tube must operate at or above atmospheric pressure to avoid collapse.

U.S. Pat. No. 1,984,802 to Mallery discloses another flexible tube system for conveying water between two points in a stream so that the "dry" streambed can be accessed for mining and other operations.

Numerous water conveyance systems have been developed to facilitate the passage of fish around stream obstructions such as hydroelectric dams. These systems typically operate by maintaining a flow of water through a conduit having internal passageways or resting places for fish, to aid in passage over a dam or past a site of stream disruption. Flow through the passageway is maintained or supplemented by pumps.

In recent years the level of environmental protection required during construction activities has increased significantly, particularly in the pipeline construction industry. Large pipeline projects, involving the crossing of hundreds of streams, are restricted to using "isolate and bypass" construction methods. More efficient high capacity stream diversion systems are needed.

A key technical objective in providing an improved water bypass system is the efficient achievement of high flow velocity when necessary, while minimizing conduit size and weight. Further, reliable operation at varying flow rates with minimal hydraulic head (provided by the stream and cofferdam systems) is desirable.

SUMMARY OF THE INVENTION

It is an object of the present invention to obviate or mitigate at least one disadvantage of previous stream diversion methods and fluid diversion conduits.

In accordance with a first aspect of the invention, there is provided a fluid diversion conduit comprising an inflow end for receiving fluid to be diverted and an outflow end for discharging diverted fluid through an outlet; the outflow end comprising a length of tubing that gradually increases in cross sectional area towards the outlet, thereby forming a hydraulic diffuser segment for slowing fluid flow to recover dynamic head prior to discharge from the outlet.

The conduit may be constructed from any suitable material, such as steel pipe, or another rigid or flexible material. Moreover, the conduit may be constructed from a combination of rigid and flexible materials. The internal surface of the conduit may be coated with a substance that minimizes skin friction flow resistance.

The hydraulic diffuser segment is constructed by splitting a pipe section longitudinally into two half sections, miter bending each half section such that the pipe sections diverge along their length, and welding approximately triangular steel plates between the bent pipe sections, thereby creating a diffuser segment of oval cross section.

In a further embodiment, the conduit further comprises flow restriction means within the conduit. Flow restriction may be useful in priming the conduit, flooding the conduit to remove air, or for restricting flow to match natural stream flow. Examples of suitable means for restricting flow include placement of a valve, flap, or other temporary obstruction within the conduit, or otherwise partially closing the conduit to flow.

In another embodiment, the conduit further comprises flow restriction means operatively associated with the conduit for restricting flow into, through, or out of the conduit.

In another embodiment, the fluid diversion conduit further comprises air displacement means operatively associated with the conduit, for eliminating air from the conduit. For example, air may be removed by vacuum extraction, displacement, or pulsed injection of steam into the conduit.

In a second aspect of the invention, there is provided a hydraulic flow diffuser for attachment to an outflow end of a fluid diversion conduit, the hydraulic flow diffuser comprising tubing of increasing cross sectional area so as to slow the flow of fluid and recover dynamic head prior to discharge of fluid from the outflow end of the conduit.

The tubing of the hydraulic diffuser may be any suitable type, size, or cross sectional shape. For example, the tubing is generally rigid, being formed solely or primarily from rigid materials, or the tubing may comprise a rigid frame covered by a membrane.

In an embodiment, the diffuser further comprises flow guide vanes for assisting in maintenance of streamline flow within the diffuser.

In another embodiment, the hydraulic diffuser further comprises flow restriction means to control fluid flow into or out of the conduit to limit air entry into the diffuser.

In another embodiment, the hydraulic diffuser further comprises a flexible extension tube for attachment to the outflow end of the conduit.

In accordance with a third aspect of the invention, there is provided a method for increasing the flow capacity of a fluid diversion conduit comprising the step of: integrating a hydraulic flow diffuser segment within an outflow end of the conduit, the hydraulic flow diffuser segment comprising a length of tubing that gradually increases in cross sectional area in the direction of flow so as to slow the flow of fluid and recover dynamic head prior to discharge of water from the outflow end of the conduit.

The tubing may be flexible or rigid and may comprise a flexible outlet end.

The method may further comprise the steps of monitoring flow conditions within the conduit and adjusting the rate of fluid flow through the conduit to maintain streamline laminar flow within the conduit.

In an embodiment, the method further comprises the step of eliminating air from the conduit. This elimination may be by vacuum extraction, pulsed steam injection, or any other suitable means.

In an embodiment, the method further comprises the step of restricting fluid flow through the conduit to flood the conduit with fluid.

In an embodiment, the method further comprises the step of restricting fluid flow through the conduit to alter the rate of flow diversion.

The present fluid diversion conduit may be made of lightweight material so as to be simply and easily transported and manipulated.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1:
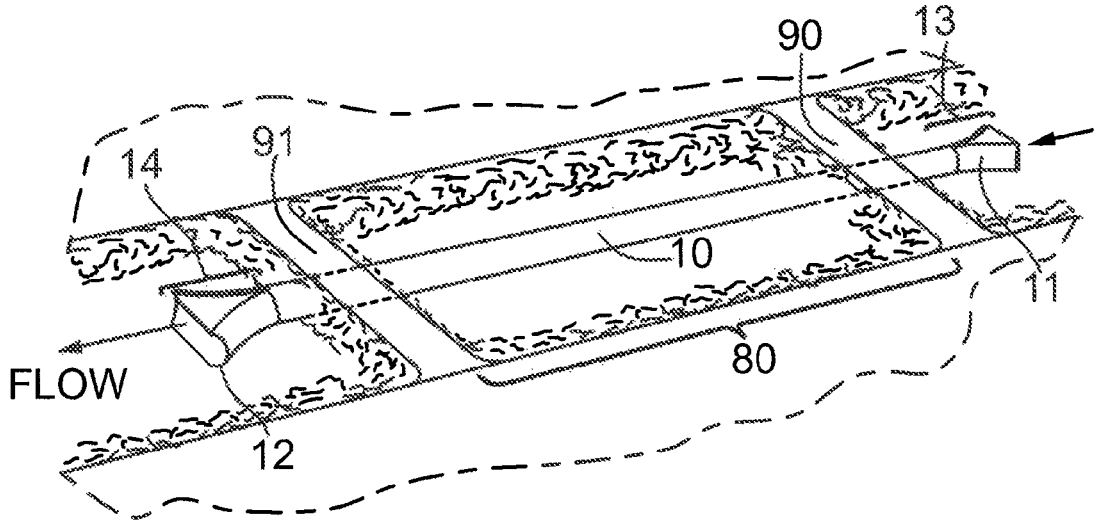
FIG. 1 is a schematic perspective view of a fluid diversion duct within a stream bed in accordance with an embodiment of the invention.

Generally, the present invention provides a fluid diversion conduit for temporarily diverting stream flow, for example to provide construction access to a portion of the streambed. With reference to FIG. 1, an upstream cofferdam 90 generates a head of hydraulic pressure upstream of the cofferdam 90, initiating flow through the diversion conduit 10. Stream flow therefore enters conduit 10 at the conduit inlet 11, is conveyed past the diversion site 80 and through a downstream cofferdam 91, where flow is returned to the natural streambed upon exiting the conduit 10 at outlet 12.

Generally, achieving higher hydraulic capacity in a flowing system is accomplished by reducing the hydraulic losses of the system. The types of hydraulic loss typically experienced in water bypass ducts include: inlet loss; skin friction loss; and exit loss. The inlet loss may be minimized by a smoothly contoured inlet configuration. This practice is widely used in culverts and other drainage systems. Skin friction losses along the length of the conduit are generally small and can be minimized by using smooth walled materials. Exit loss may be minimized by incorporation of a hydraulic diffuser at the conduit exit, as described below with reference to the Figures.

A problem with existing flumes and open channel flow "super flumes" is that fluid enters the flume at a given velocity, and flows through the flume and returns to the stream at the same velocity. Therefore, the hydraulic head provided by any damming at the conduit inlet is lost at the conduit exit. This exit hydraulic loss is typically greater than the inlet and friction losses combined. The high energy in the discharge flow poses further problems because it causes erosion of the downstream streambed. This erosion may be minimized by placement of diffusing blockages within the downstream flowpath to increase turbulence, which intentionally wastes the hydraulic head in the discharge flow.

Hydraulic Diffuser Segment

Fluid diversion conduits may vary in shape, size, and material. The term conduit as used with the diffuser segments described below refers to any rigid passageway used to convey fluid from one location to another. The conduit should be of sufficient rigidity to avoid collapse during streamline laminar flow under suction, as will be described below. The shape and size of the conduit may vary widely, as addition of a diffuser segment to any fluid diversion conduit will increase the flow capacity of the conduit when operating under streamline laminar flow conditions.

Figure 2A:
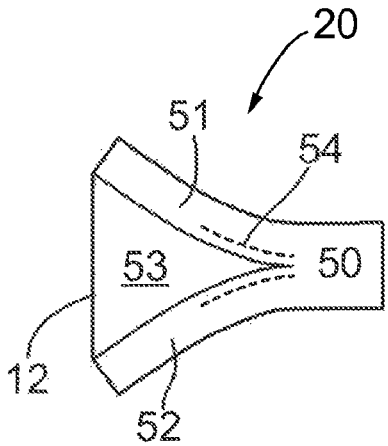
FIGS. 2*a* and 2*b* are schematic top cross section and end views, respectively, of a diffuser end in accordance with an embodiment of the invention.
Figure 2B:
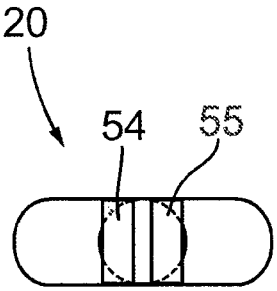

With reference to FIGS. 2*a* and 2*b*, the conduit outflow end 14 (the portion of the conduit that extends through and/or past the downstream cofferdam) includes a hydraulic diffuser segment 20 for recovery of dynamic head from the water flow within the conduit, increasing the hydraulic capacity of the water bypass system beyond what is possible with an identical sized cylindrical conduit (estimated increase of approximately 50%). The increased capacity accommodated by incorporation of a hydraulic diffuser segment 20 within the conduit allows the use of a smaller, less expensive, more easily deployed water bypass conduit for the stream bypass.

Specifically, hydraulic exit loss is minimized within the diffuser segment 20 by slowing fluid flow prior to exit from the conduit. As the cross sectional area of the diffuser segment increases towards conduit outlet 12, the fluid flow paths diverge to fill the larger cross-sectional area, thereby reducing the velocity of the water. The dynamic energy lost as flow velocity is converted to a pressure differential across the length of the diffuser segment, effectively reducing the diffuser inlet pressure and increasing the discharge pressure. Since the diffuser section is at or near the outflow end 14 of the conduit, and the discharge pressure is approximately constant, suction is created within the diffuser, and therefore also along the length of the conduit back to the conduit inlet 11. This suction serves to pull more water into the inflow end 13 (portion of the conduit that extends through and/or protrudes from the upstream cofferdam) of the conduit 10, thereby increasing the overall hydraulic capacity of the conduit.

Since the diffuser section operates at comparatively high flow velocities with respect to general conduit fluid hydraulics, the enlargement must be gradual to maintain streamline flow. Stated in more technical terms, due to the high Reynold's number associated with flow in the diffuser, the degree of cross sectional enlargement to form the diffuser segment must be very gradual to avoid "boundary layer separation" at the diffuser walls, which would interfere with the development of streamline laminar flow and head recovery.

For greater clarity, as in understood in the field of fluid dynamics, the Reynold's number is a ratio of the fluid momentum forces to the viscous forces within a flowing liquid. At a low Reynold's number, representing a very viscous fluid, flow easily remains laminar and the surfaces over which flow passes do not greatly alter this laminar flow. By contrast, a high Reynold's number indicates that the surface over which fluid passes must be streamlined and any changes in shape should be very gradual in order to maintain laminar flow and avoid boundary layer separation. If boundary layer separation occurs, turbulence will waste hydraulic energy. Should a dramatic change in direction be required, a mid stream vane may be placed proximal to the flow surface to further guide fluid in laminar flow.

Flow guide vanes 54, 55 may therefore be used in the diffuser section to assist in prevention of boundary layer separation. Other features useful to maximize the diffuser hydraulic performance are discussed below.

Construction of Hydraulic Diffuser Segment

Large stream bypass ducts used in pipeline construction operations must be robustly constructed and are usually fabricated from welded steel pipe. Therefore, the diffuser segment 20 may also be formed from such pipe for consistency and efficiency. Alternatively, the diffuser segment may be made of another suitable rigid or flexible material. Further, the diffuser may have a rigid portion and a flexible portion to maximize performance.

With reference to FIG. 2, a hydraulic diffuser segment 20 is constructed from mitre bent pipe wall sections and includes flow vanes 54, 55 to assist in maintaining streamline flow (preventing "boundary layer separation") in the throat of the diffuser 20. A section of pipe 50 is split longitudinally from one end, and the resulting pipe half sections 51, 52 are mitre bent apart. A steel plate 53 is cut to corresponding shape and is welded in place to fill the gap between the bent pipe half sections. As mentioned above, the mitre bending must be done gradually and precisely so as to create a diffuser conducive to maintenance of streamline flow. As shown in FIG. 2*b*, the resulting cross sectional profile of the diffuser is generally oval, expanding in length but not in height. Although other cross sectional profiles may be effective, it is desirable in most instances to maintain the diffuser beneath the downstream water level to limit air entry into the diffuser. This purpose is typically facilitated by using an oval or other cross sectional shape that expands in the horizontal direction with minimal expansion in the vertical direction.

The diffuser segment 20 may include curved diffuser vanes 54, 55, which may be cut from flat steel, curved to match the flow streamlines in the diffuser, and then welded into the throat of the diffuser.

Figure 3:
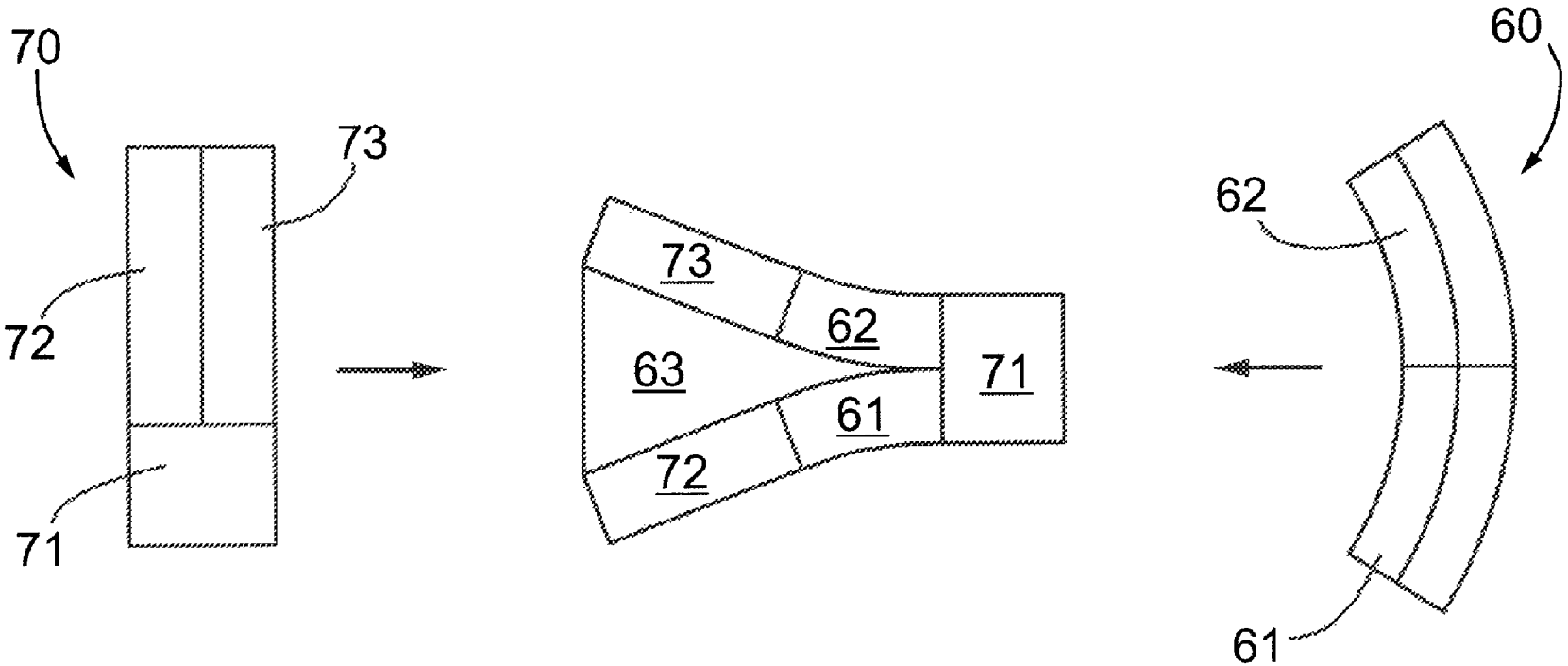
FIG. 3 is a schematic top view of a diffuser end assembled by cutting and joining bent and straight lengths of pipe.

FIG. 3 shows the details of a hydraulic diffuser section constructed from bent pipe wall sections. A pipe section 60 is bent to a smooth curved shape and cut longitudinally as shown to create curved half sections 61, 62. A length of straight pipe 70 is cut cross-sectionally to create straight pipe 71, and the remaining pipe section is cut longitudinally to create straight pipe half sections 72, 73. Curved half sections 61, 62 are welded to straight pipe section 71 to extend the pipe in length and horizontal diameter. Straight half sections 71, 72 are then attached to the bent half sections to further increase the cross sectional area of the diffuser. Plates 63 are then cut to corresponding shape and welded in place to fill the gap between the pipe half sections.

As described above, vanes may be placed within the throat of the diffuser to assist with maintenance of streamline flow.

It should be explicitly noted that the hydraulic diffuser segment may be constructed independent of conduit construction, for attachment thereto by welding or other means. Alternatively, the diffuser segment may be constructed integral with the conduit. Construction of the diffuser segments may occur on or off-site.

Operational Considerations

Due to the natural stream flow velocity as well as the presence of an upstream cofferdam 90, fluid is accelerated towards the conduit inlet 11, and enters the inflow end 13 of the conduit, with a portion of the total hydraulic head converted to velocity or dynamic head. Fluid therefore flows through the conduit 10 at a velocity greater than the natural stream flow velocity, however a further portion of the hydraulic head is lost due to skin friction interaction with the conduit walls during passage along the length of the conduit. As such, coatings such as smooth paint may be applied to the inner surface of the conduit and diffuser to limit skin friction loss, or other skin friction reducing methods may be incorporated into the presently described system.

Upon passage of fluid into the diffuser segment 20, flow velocity is gradually reduced as the cross-sectional area of the diffuser increases, and most of the dynamic head is converted back to hydraulic head. The water then exits the conduit at a slowed velocity and with a total hydraulic head approximately matching that of the normal downstream flow. Due to reduced discharge velocity from the diffuser, no downstream erosion control measures are required.

Preventing Air Entry

The water conveyance assembly will often be operated in shallow streams where the inlet and outlet are not deeply submerged, making air entry into the conduit possible. Significant air volumes in the diffuser section of the conduit would likely result in disruption of streamline flow, i.e. "boundary layer separation", and a reduction or loss of the dynamic head recovery. In such circumstances, certain compensations may be made to avoid air entry, or to expel air from the conduit.

Figure 4A:
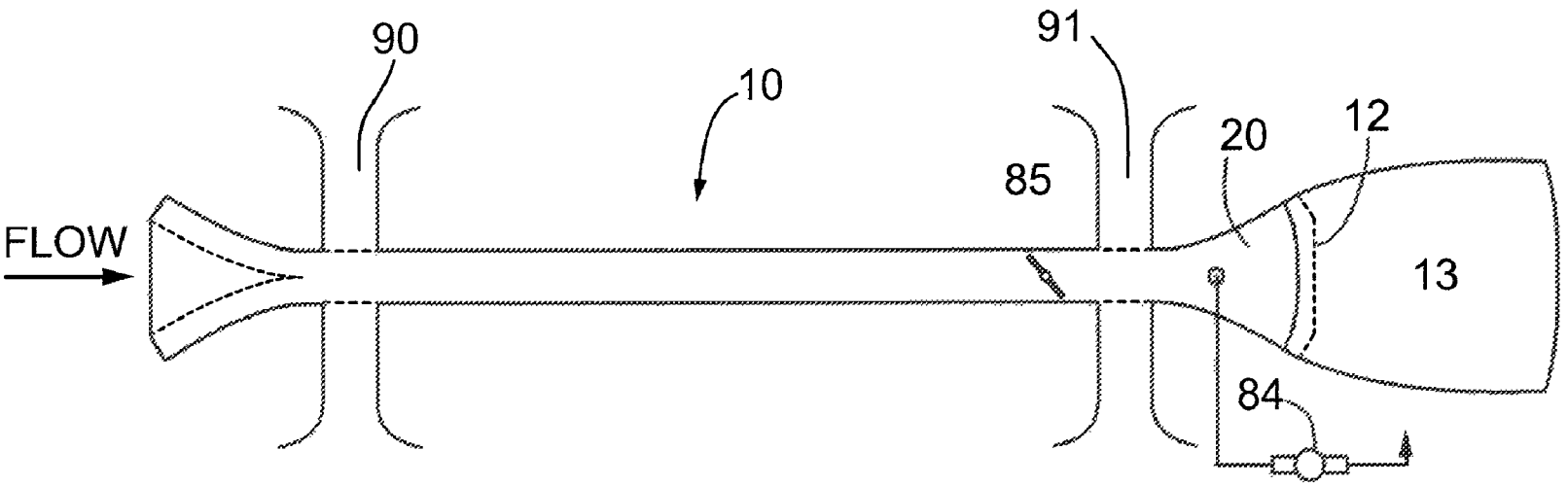
FIGS. 4*a* and 4*b* are schematic plan and elevational views of a fluid bypass system within a streambed in accordance with an embodiment of the invention; and, FIG. 5 is a schematic perspective view of a diffuser end and flow control mechanism, in accordance with an embodiment of the invention.
Figure 4B:
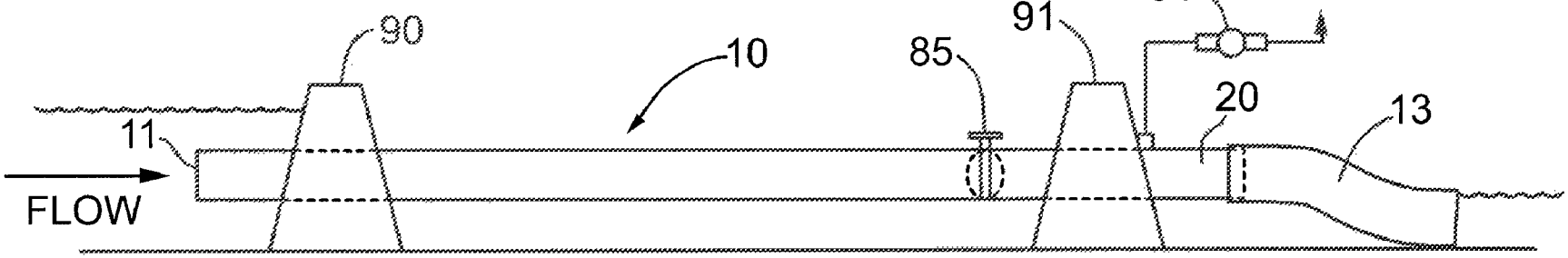

FIGS. 4*a* and 4*b* show plan and profile views, respectively, of an embodiment suitable for use with low downstream water levels, including mechanisms for expelling air and for keeping air out of the conduit 10. Conduit inlet 11 is fully submerged due to appropriate damming at the inlet end, and air entry at the conduit inlet is therefore unlikely. As the downstream water level may fluctuate and at times be lower than the uppermost wall of the diffuser 20 and outlet 12, air entry may occur, disrupting the laminar streamline flow and suction effect created within the diffuser segment 20. A flexible extension tube 13 is fitted to the outlet 12, which is collapsible to the water surface, and is thereby maintained at/under the water surface by the weight and drag of water once flow is initiated. The flexible extension tube 13 therefore prevents air entry into the conduit despite modest variations in the downstream water level. As water flows through the duct and flexible tube, the tube assumes a shape conforming to the water stream, and the complete inner surface of the tube is in contact with the water stream. This leaves no flow area for air to enter the diffuser in "counter-flow" to the water.

The diffuser 20 may further be designed with a downward curve or downward-facing outlet to ensure the outlet remains beneath the downstream water level. These accommodations will further minimizing the risk of air entry into the conduit from the downstream end.

Expulsion of Air

In addition to prevention of air entry, in certain circumstances (e.g. upon initiation of flow), it may be desirable to expel air from the conduit to "prime" the diffuser. Therefore, the diffuser may include means for extracting air from the conduit until appropriate streamline flow (and suction) is achieved.

As an example, FIG. 4 depicts a vacuum source or pump 84, hydraulically connected to the diffuser, which may be activated to expel air from the conduit in order to achieve streamline flow. Once appropriate flow parameters are achieved, fluid flowing through the diffuser slows in velocity due to the enlarging cross-sectional flow area, and dynamic head is recovered.

As another example, the vacuum source 84 may be replaced with a high capacity steam source (not shown). When necessary, a blast of steam may be forced into the conduit to displace air. As the steam cools and condenses, the duct is thereby flooded with water, such that air space within the conduit is eliminated.

Flow Control

The conduit may further include means for restricting or controlling flow through the conduit. If the hydraulic capacity of the conduit significantly exceeds the stream flow rates, the upstream water level may fall below the duct inlet, and air may then enter the conduit, interfering with the diffuser hydraulics. One suitable means and location for controlling fluid flow is indicated in FIG. 4 by valve 85 (for example a butterfly valve). This valve 85 may be used to restrict water flow through the duct to adjust conduit capacity when flow is minimal.

Figure 5:
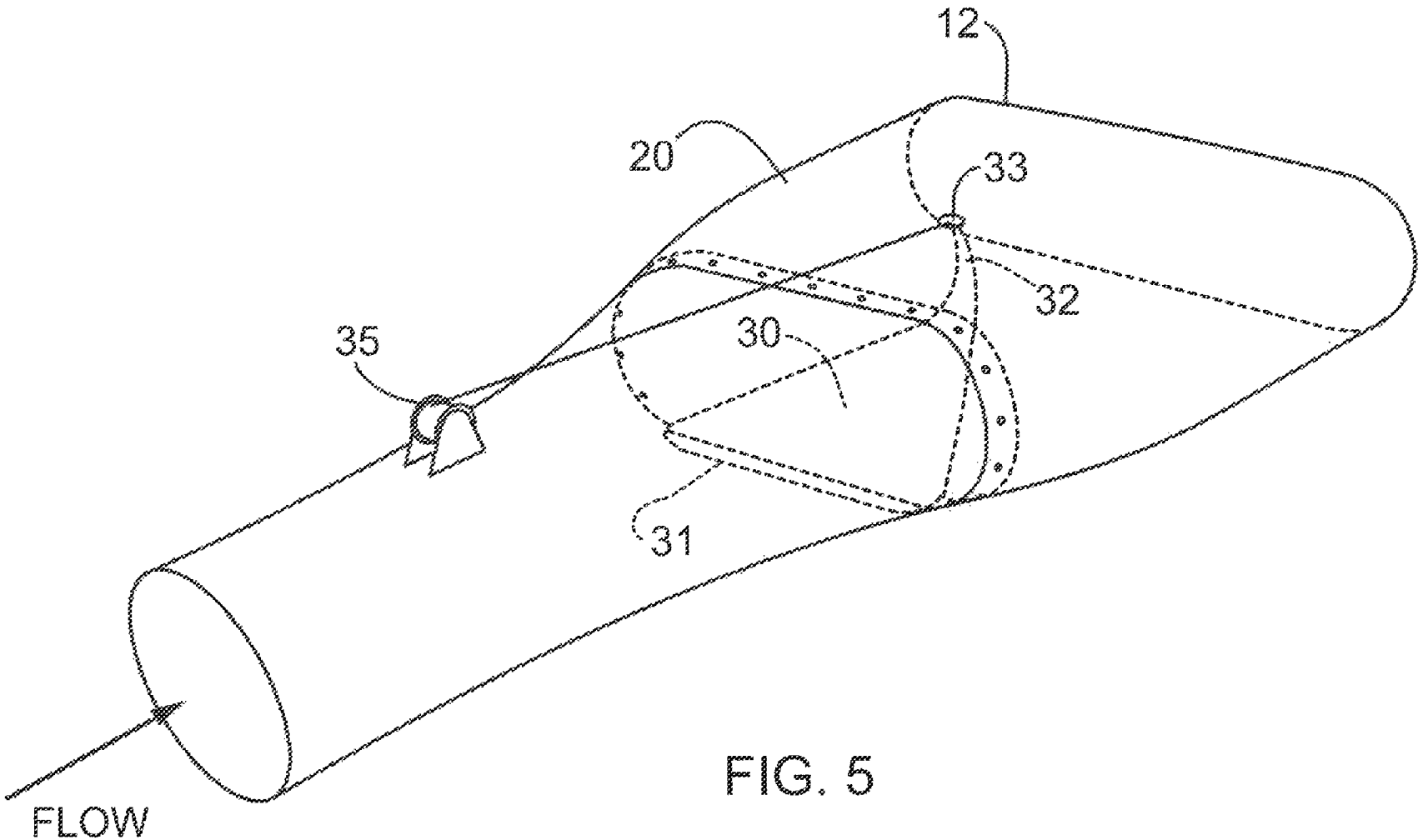

Another suitable means for restricting the flow for a different purpose is shown in FIG. 5. A triangular flap 30 in the diffuser 20 may be manipulated to restrict flow from the outlet. Such flow restriction will cause the conduit to flood with fluid, thereby priming the duct. Other alternatives for restricting the flow include: pinching down the outlet 12 when a flexible membrane tube 13 is attached to the discharge of the diffuser or when the diffuser is made from flexible material; inflating a bladder within the conduit; sliding a plate to obscure the conduit; or otherwise obstructing flow within the conduit or discharge from the outlet.

With reference to FIG. 5, flap 30 is affixed within the diffuser to occlude the outlet 12. The flap 30 is made from resilient, flexible material, and is secured at base edge 31 to the diffuser. The remainder of the flap 30 extends towards the outlet along the bottom inner surface of the diffuser during normal use. The "downstream" flap edge 32 is connected to a cable 33, which is threaded through a port 34 in the top surface of the diffuser and connected to a winch 35. Thus, the downstream flap edge 32 may be drawn upwards, in this example by tightening a winch 35 on the outside surface of the conduit, which progressively draws the flap edge 32 into the flow stream by pulling on a wire that has been fed through a port 33 on the surface of the diffuser 20, thereby manipulating the degree of obstruction of fluid flow from the conduit 10.

Upon setup of the conduit diversion system, the conduit may be primed by drawing the flap in to restrict flow discharge from the conduit. The conduit will therefore be filled with water and air may be expelled from the conduit as necessary during this priming step. Subsequently, to initiate laminar streamline flow and maximal conduit capacity, the winch 35 is unwound to release the flap and allow fluid to be discharged from the outflow end of the conduit 10. Notably, the winch should be unwound gradually so the flow of fluid through the conduit may be monitored and matched to the natural stream flow rate. An automatic winch control system can be used to detect the upstream water level and adjust the flap as required. To achieve maximum duct flow capacity the flap can be fully released so that the whole flap lies flat along the bottom of the flexible membrane tube and does restrict the flow at all.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A water diversion conduit for use in diverting flowing water from a waterway, the conduit comprising an inflow end for receiving water to be diverted and an outflow end for discharging diverted water through an outlet; the outflow end comprising a length of rigid tubing that gradually increases in cross sectional area towards the outlet, thereby forming a hydraulic diffuser segment for slowing water flow to recover dynamic head prior to discharge of the diverted water from the outlet; and a length of flexible tubing extending from the outlet to minimize entry of air into the outlet.

2. The water diversion conduit as in claim 1 that is constructed from steel pipe.

3. The water diversion conduit as in claim 1, further comprising flow guide vanes within the diffuser segment for assisting in maintenance of laminar flow within the diffuser segment.

4. The water diversion conduit as in claim 1, wherein the internal surface of the conduit is coated with a substance that minimizes hydraulic skin friction flow resistance.

5. The water diversion conduit as in claim 1, wherein the diffuser segment is constructed by splitting a pipe section longitudinally into two half sections, miter bending each half section such that the pipe sections diverge along their length, and welding approximately triangular steel plates between the bent pipe sections, thereby creating a diffuser segment of oval cross section.

6. The water diversion conduit as in claim 1, further comprising flow restriction means within the conduit.

7. The water diversion conduit as in claim 1, further comprising flow restriction means operatively associated with the conduit for restricting flow into, through, or out of the conduit.

8. A water diversion conduit for use in diverting flowing water from a waterway, the conduit comprising:

an inflow end for receiving water to be diverted and an outflow end for discharging diverted water through an outlet;

the outflow end comprising a length of rigid tubing that gradually increases in cross sectional area towards the outlet, thereby forming a hydraulic diffuser segment for slowing water flow to recover dynamic head prior to discharge of the diverted water from the outlet; and air displacement means operatively associated with the conduit for eliminating air from the conduit.

9. A hydraulic flow diffuser for integration within an outflow end of a water diversion conduit, the hydraulic flow diffuser comprising:

a length of rigid tubing of increasing cross sectional area so as to slow the flow of water and recover dynamic head prior to discharge of water from the outflow end of the conduit, and a flexible extension tube for attachment to the outflow end of the conduit.

10. The hydraulic diffuser as in claim 9, wherein the tubing is oval in cross section.

11. The hydraulic diffuser as in claim 9, further comprising flow guide vanes for assisting in maintenance of streamline flow within the diffuser.

12. The hydraulic diffuser as in claim 9, further comprising flow restriction means to control water flow into or out of the conduit.

13. A method for increasing the flow capacity of a water diversion conduit comprising the step of:

integrating a hydraulic flow diffuser segment within an outflow end of the conduit, the hydraulic flow diffuser segment comprising a length of rigid tubing that gradually increases in cross sectional area in the direction of flow so as to slow the flow of water and recover dynamic head prior to discharge of water from the outflow end of the conduit; and wherein the conduit further comprises a flexible outlet end.

14. The method as in claim 13, further comprising the steps of monitoring flow conditions within the conduit and adjusting the rate of water flow through the conduit to maintain streamline laminar flow within the conduit.

15. A method for increasing the flow capacity of a water diversion conduit comprising the step of:

integrating a hydraulic flow diffuser segment within an outflow end of the conduit, the hydraulic flow diffuser segment comprising: a length of rigid tubing that gradually increases in cross sectional area in the direction of flow so as to slow the flow of water and recover dynamic head prior to discharge of water from the outflow end of the conduit; and eliminating air from the conduit.

16. The method as in claim 15, wherein air is eliminated by vacuum extraction.

17. The method as in claim 15, wherein air is eliminated by pulsed injection of steam into the conduit.

18. The method as in claim 13, further comprising the step of restricting water flow from the conduit to flood the conduit with water.

19. The method as in claim 13, further comprising the step of restricting water flow through the conduit to alter the rate of flow diversion.

* * * * *